United States Patent [19]

Powell et al.

[11] Patent Number: 5,065,590

[45] Date of Patent: Nov. 19, 1991

[54] REFRIGERATION SYSTEM WITH HIGH SPEED, HIGH FREQUENCY COMPRESSOR MOTOR

[75] Inventors: James W. Powell, Hartland; Mark G. Voss, Brighton; Bryan N. Waineo, Northville, all of Mich.

[73] Assignee: Williams International Corporation, Walled Lake, Mich.

[21] Appl. No.: 582,245

[22] Filed: Sep. 14, 1990

[51] Int. Cl.[5] ..... F25B 1/10; F25B 31/02

[52] U.S. Cl. ..... 62/175; 62/510; 62/509

[58] Field of Search ..... 62/498, 510, 175, 149, 62/117, 509; 310/169

[56] References Cited

U.S. PATENT DOCUMENTS

| | | | |
|---|---|---|---|
| 2,024,323 | 12/1935 | Wyld | 62/510 |
| 2,587,485 | 2/1952 | Kline | 62/510 |
| 3,011,322 | 12/1961 | Tanzberger et al. | 62/510 |
| 3,848,422 | 11/1974 | Schibbye | 62/468 |
| 4,151,724 | 5/1979 | Garland | 62/510 |
| 4,868,438 | 9/1989 | Okamoto et al. | 310/166 |
| 4,871,934 | 10/1989 | Okamoto et al. | 310/166 |

FOREIGN PATENT DOCUMENTS

| | | | |
|---|---|---|---|
| 0138106 | 4/1930 | Switzerland | 62/510 |
| 0809190 | 8/1979 | U.S.S.R. | 62/510 |

*Primary Examiner*—Albert J. Makay
*Assistant Examiner*—William C. Doerrler
*Attorney, Agent, or Firm*—Lyon & Delevie

[57] ABSTRACT

A refrigeration system utilizes a small high speed centrifugal compressor driven by a directly coupled, high frequency, electric motor. The motor has a double-ended shaft which supports the rotors of low pressure and high pressure centrifugal compressor stages. The motor operates in the refrigerant atmosphere so as to eliminate the requirement for rotating shaft seals. High frequency power (3750 Hz) is supplied to the motor, which runs at 75,000 RPM. The system utilizes a novel flash intercooler between the compressor stages.

2 Claims, 4 Drawing Sheets

REFRIGERATION SYSTEM WITH HIGH SPEED, HIGH FREQUENCY COMPRESSOR MOTOR

BACKGROUND OF THE INVENTION

Electrically driven vapor cycle refrigeration systems utilizing conventional D.C. or low frequency A.C. electric motors exhibit weight and volume characteristics that are undesirable in certain applications, for example, over the road automotive applications, which require that component size be minimized. Moreover, known refrigeration systems generally use piston compressors and heat exchangers which are relatively large and inefficient.

SUMMARY OF THE INVENTION

The refrigeration system of the present invention utilizes a small high speed centrifugal compressor driven by a directly coupled, high frequency, electric motor. Specifically, the motor/compressor unit comprises a high frequency, high speed motor having a common double-ended shaft which supports the rotors of the low pressure and high pressure centrifugal compressor stages. The entire system operates in the refrigerant atmosphere so as to eliminate the requirement for rotating shaft seals. To obtain the necessary high speed, for example 75,000 RPM, without brushes, high frequency power at 3750 Hz is supplied to the motor, which can be obtained from either a high frequency mechanically driven generator or from a suitable inverter.

In operation, cold vapor at low pressure exits an evaporator unit and flows to the inlet of a low pressure centrifugal compressor stage. The low pressure compressor elevates the pressure and inherently adds heat. The working fluid exits the low pressure compressor as a hot, medium pressure vapor and is piped to a flash intercooler.

Medium pressure liquid is also introduced into the conduit from the low pressure compressor to the flash intercooler. Since the pressure in this line and in the intercooler is less than the saturation pressure of the liquid, some of the liquid boils and in so doing absorbs heat thereby cooling the gas introduced to the intercooler.

The cooled medium pressure gas, including any evaporated liquid is piped to the high pressure compressor. The high pressure compressor raises the pressure of the working vapor and adds heat so that high pressure, hot vapor is delivered to the condenser. Heat is removed from the hot vapor in the condenser and is delivered to atmosphere permitting the vapor to condense to liquid and exit the condenser. The liquid then flows through a head regulator valve to reduce its pressure to an intermediate level for introduction to the flash intercooler.

The portion of the liquid which does not boil in the flash intercooler is removed through an expansion valve to reduce its pressure to evaporator pressure and then is inducted into the evaporator. The liquid boils in the evaporator and thereby removes heat from the air stream to be cooled.

At a fixed speed, centrifugal compressors operate within a well-defined range of fluid flow. Accordingly, a bypass is provided to insure that flow through the low and high pressure compressors never drops below a predetermined minimum. A bypass control valve can be adjusted to maintain the proper flow through the compressors.

DETAILED DESCRIPTION OF THE PREFERRED EMBODIMENT OF THE INVENTION

Figure 1:
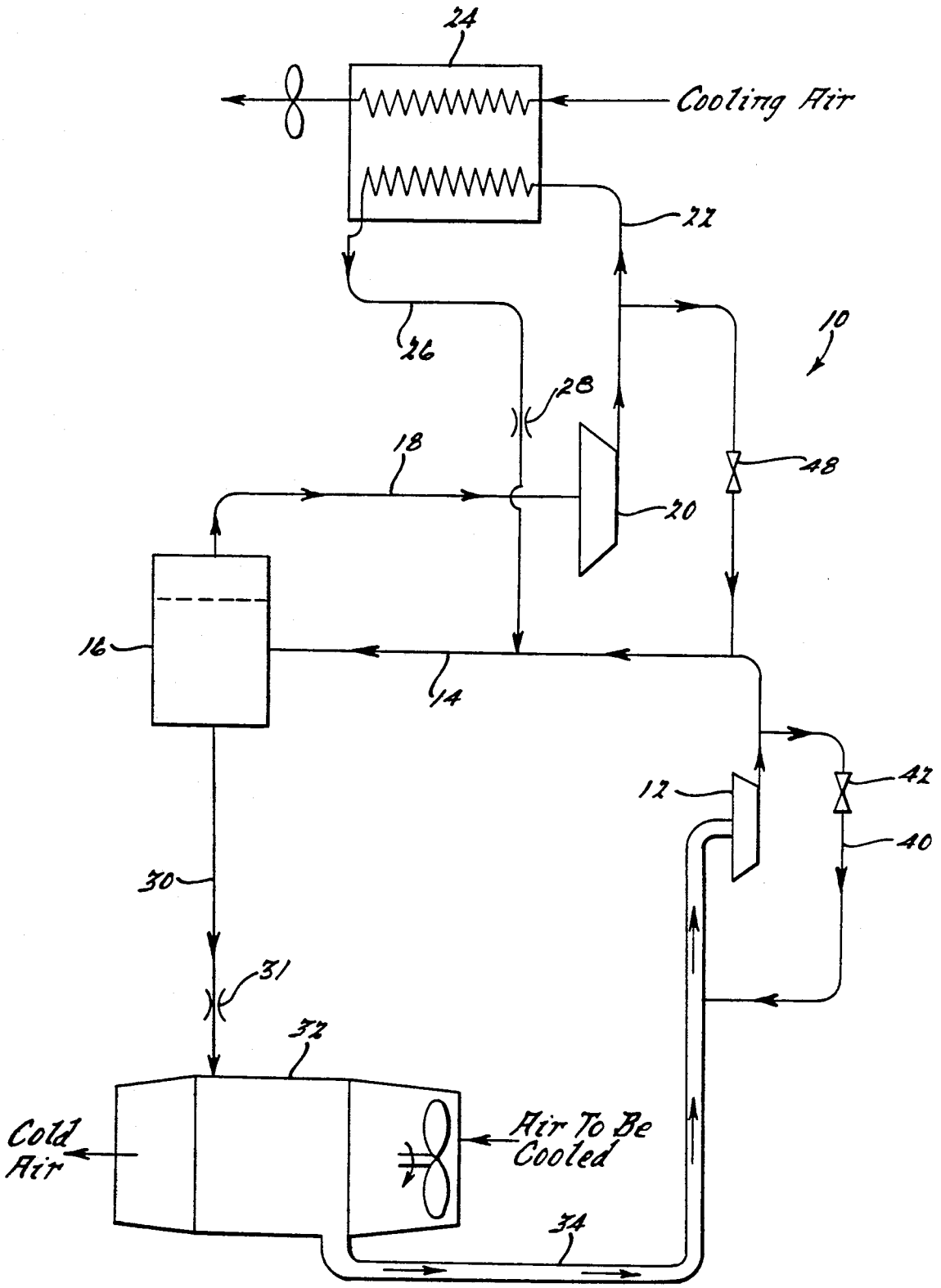
FIG. 1 is a general schematic of the refrigeration system of the invention.
Figure 2:
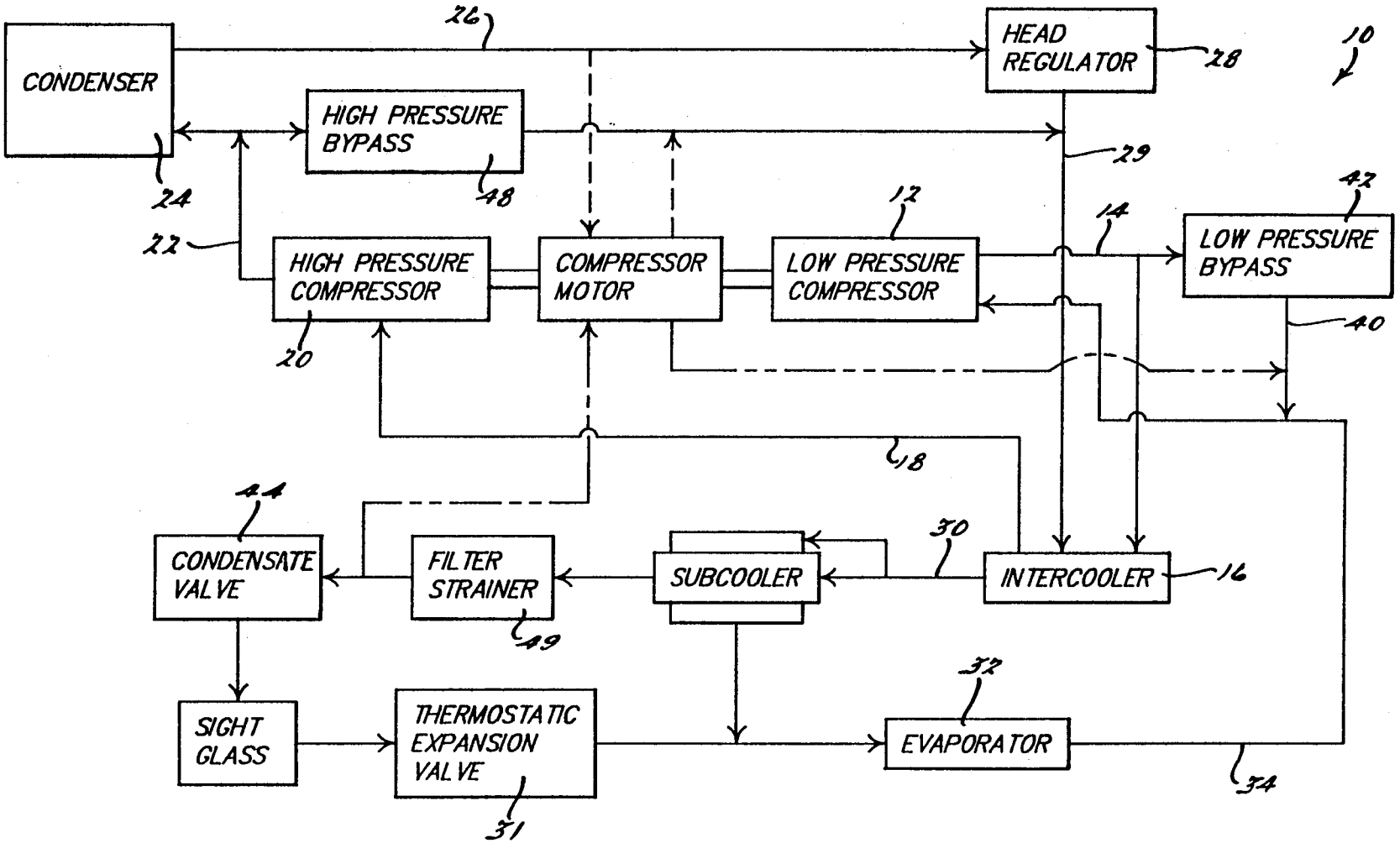
FIG. 2 is a detailed schematic of the refrigeration system.

As best seen in FIGS. 1 and 2 of the drawings, a refrigeration system 10, in accordance with an exemplary constructed embodiment of the instant invention broadly comprises a low pressure compressor 12 that is connected through a line 14 to a flash intercooler 16. The flash intercooler 16 is connected through a line 18 to a high pressure compressor 20. The high pressure compressor 20 is connected through a line 22 to a condenser 24 which, in turn, is connected through a line 26, head regulator valve 28 and line 29 to the flash intercooler 16.

The flash intercooler 16 is also connected through a line 30 and expansion valve 31 to an evaporator 32 which, in turn, is connected through a line 34 to the intake of the low pressure compressor 12. In accordance with one feature of the invention, a bypass line 40 is connected through a low pressure bypass control valve 42 to the output line 14 from the low pressure compressor 12 as well as to the input line 34 thereof.

More specifically, as seen in FIG. 2, a condensate valve 44 comprising a normally closed solenoid valve is necessary to permit start-up of the system 10. The condensate valve 44 is controlled by a pressure differential switch (not shown) which, upon closure, opens the condensate valve 44 when the evaporator pressure has been pulled down by the compressors 12 and 20 to a value sufficiently below system pressure. This action permits the compressors 12 and 20 to start at minimum load and establishes the initial evaporator pressure.

The low pressure bypass valve 42 is set to bypass hot gas back to the inlet of the low pressure compressor 12 whenever the absolute inlet pressure is less than its set value. This maintains the evaporator 32 at a fixed pressure which, in turn, establishes the saturation temperature (i.e., the boiling point) of the fluid in the evaporator 32.

The thermal expansion valve 31 controls the flow of liquid Freon into the evaporator 32 to maintain a substantially constant evaporator exit temperature. This temperature is selected to maintain a few degrees of superheat. If the refrigerant flow is insufficient to absorb the heat input to the evaporator 32, the evaporator exit temperature increases which causes the valve 31 to admit more liquid refrigerant to absorb the heat.

The thermal expansion valve 31 comprises a commercially available expansion valve which has been altered to accommodate the low pressures associated with the use of a conventional low density refrigerant, for example, Freon R-113. Typically, rising temperature at the evaporator exit causes the valve 31 to open and admit more refrigerant to the evaporator 32.

The expansion valve 31 holds constant superheat in the evaporator exit fluid. To accomplish this, it is necessary to fill the thermal-sensing bulb thereof (not shown) with refrigerant so that the diaphragm force balance is influenced by the difference between the temperature sensing bulb pressure and the evaporator pressure. These pressures are so low that, even with an extra-flexible diaphragm, operation is unsatisfactory. As a result, a relatively high pressure sensing fluid is used with the result that evaporator pressure only slightly influences the force balance on the expansion valve diaphragm so that the valve response is almost exclusively a function of evaporator temperature.

A high pressure bypass valve 48 is similar in operation to the low pressure bypass valve 42 in that it opens and bypasses high pressure outlet flow back to the high pressure inlet system at the intercooler 16 whenever the inlet pressure is lower than the set value. This action establishes an absolute value for the intercooler 16 pressure and, hence, for the low pressure discharge.

The establishment of the low pressure discharge by the high pressure bypass valve 48 and the low pressure inlet pressure by the low pressure bypass valve 42 establishes the pressure ratio across the low pressure compressor 12. This pressure ratio has been selected to insure surge-free operation of the low pressure compressor 12.

The head regulator 28 is a simple pressure differential valve which controls liquid in the refrigerant line 26 from the condenser 24 to the intercooler 16. Since the intercooler 16 pressure is established by the high pressure bypass valve 48, as described above, the maintenance of a fixed increment above this pressure establishes a fixed value for the condenser pressure and, hence, the high pressure discharge pressure. The control of both high pressure inlet and outlet pressures provides the necessary pressure ratio control.

In some situations, the physical location of components requires that flow must rise from the intercooler 16 to a filter/strainer 49. This causes enough local pressure reduction to induce some boiling of the saturated liquid. To preclude this, it is necessary to subcool the liquid. This is accomplished by diverting a small portion of the intercooler effluent through an orifice into the subcooler jacket surrounding the main liquid flow. This region is connected to the evaporator 32 and maintained at evaporator pressure. As a consequence, the bypassed fluid evaporates and cools the main liquid stream.

Figure 4:
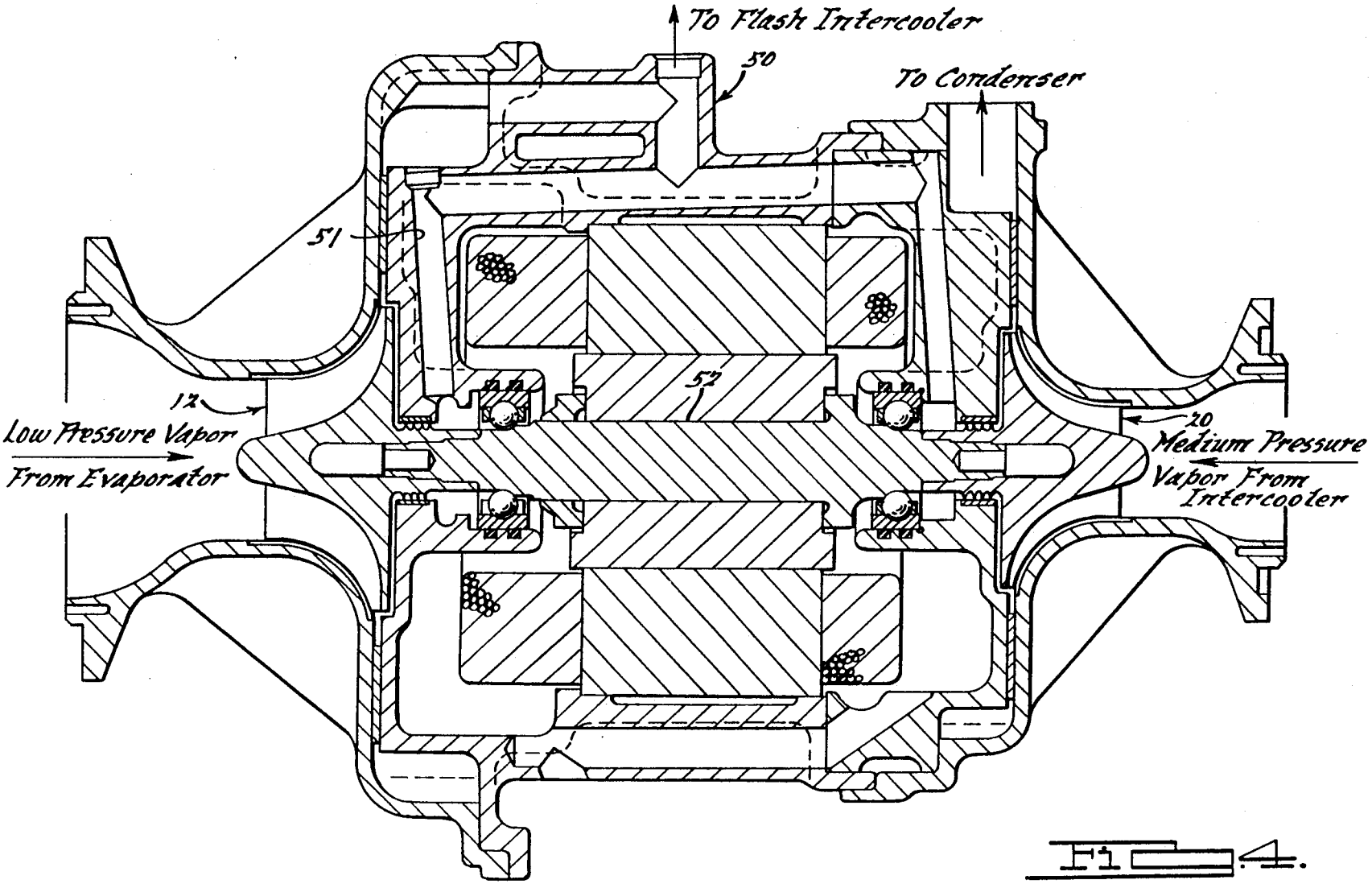
FIG. 4 is a vertical cross-section of the high speed combination low and high pressure compressor used in the system of FIG. 1.

As best seen in FIG. 4 of the drawing, the low pressure compressor 12 and high pressure compressor 20 are housed within a single motor housing 50, internal passages 51 thereof eliminating the requirement for external shaft seals. The low pressure compressor 12 and high pressure compressor 20 are mounted on a common shaft 52 so as to be rotatable at the same speed. The low pressure compressor 12 is supplied with low pressure vapor from the evaporator 32 and the high pressure compressor 20 is supplied with medium pressure vapor from the flash intercooler 16.

Figure 3:
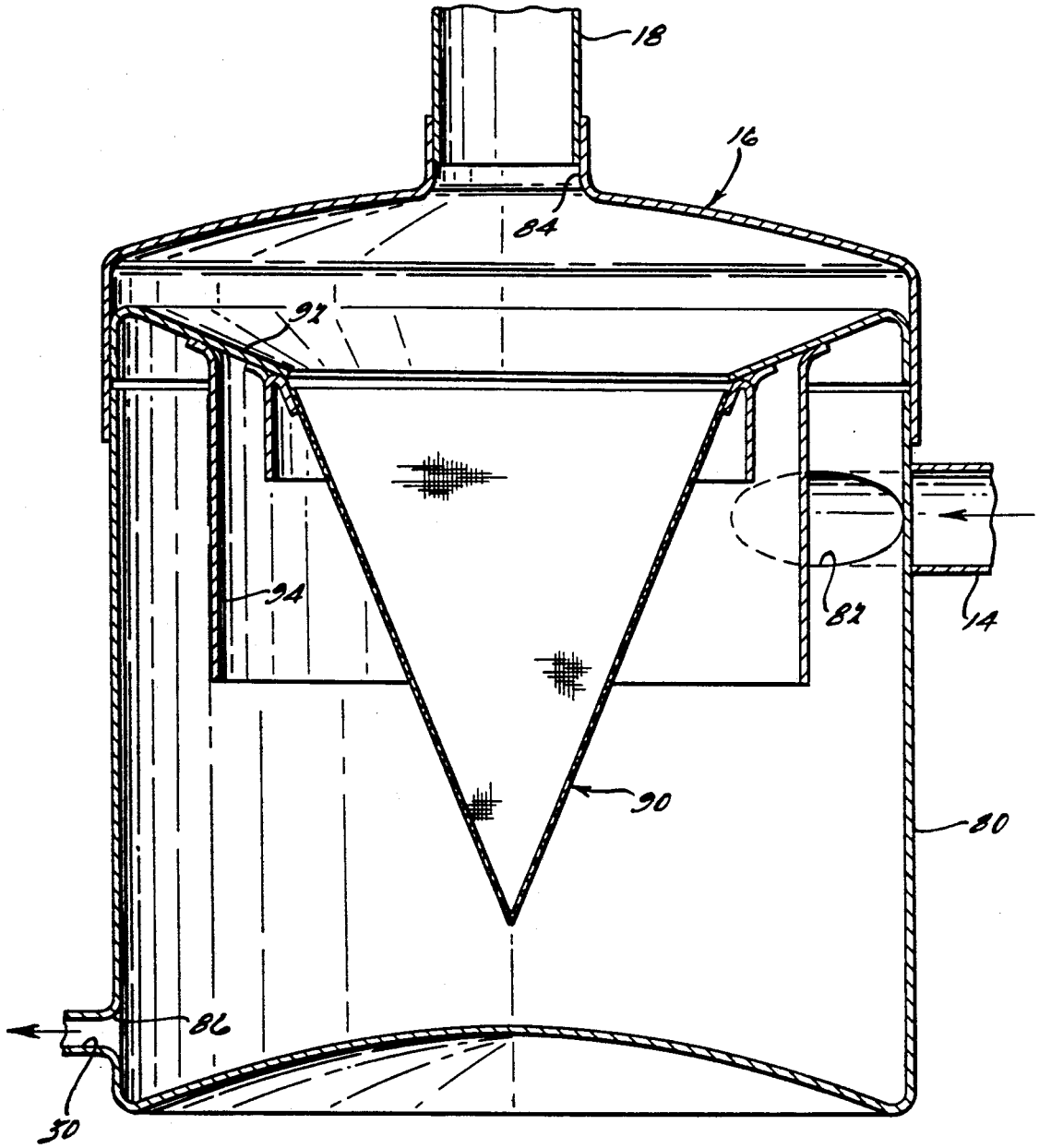
FIG. 3 is a vertical cross-section of the flash intercooler used in the system of FIG. 1.

As best seen in FIG. 3 of the drawing, the flash intercooler 16 comprises a cylindrical canister 80 having an inlet aperture 82 in communication with the medium pressure vapor line 14 from the low pressure compressor 12. A second aperture 84 in the canister 80 communicates with the medium pressure vapor line 18 leading to the high pressure compressor 20. In addition, the canister 18 is provided with an aperture 86 that communicates with the fluid line 30 leading to the evaporator 32.

The flash intercooler 16 is provided with a conical screen made from, for example, $38 \times 38 \times 0.015$ wire mesh. The screen 90 is supported by an annular radially inwardly extending flange 92 in coaxial relationship with the central axis of the canister 80. An annular flange 94 depends downwardly from the flange 92 in radially inwardly spaced relation to the outer cylindrical wall of the canister 80 and radially outwardly of the conical screen 90.

As seen in FIG. 2, compressor lubrication requirements are met by utilizing a miscible lubricant in the refrigerant. Intermediate pressure liquid from the intercooler 16 enters the compressor motor housing and is expanded, causing the liquid refrigerant to flash from the lubricant. The gaseous refrigerant then functions as a propellant for the resultant lubricant aerosol which is conducted to the bearings. The compressor motor is then scavenged through a line 100 to the low pressure line 40 thence to the low pressure compressor 12.

In summary, cold vapor at low pressure is conducted by line 34 from the evaporator 32 to the low pressure compressor 12. The centrifugal low pressure compressor 12 elevates the pressure of the vapor and adds heat thereto. The fluid exits the low pressure compressor 12 as a hot, medium pressure vapor and flows through line 14 to the flash intercooler 16.

Medium pressure liquid is also introduced through line 29 into the line 14 from the condenser 24 for subsequent flow to the flash intercooler 16. Since the pressure in line 14 and in the flash intercooler 16 is less than the saturation pressure of liquid entering from line 14, some of the liquid boils and in so doing absorbs heat thereby cooling the gas exiting the flash intercooler 16.

Medium pressure gas is conducted to the high pressure compressor 20 through line 18. The high pressure compressor 20 further increases the vapor pressure and adds heat thereto so that high pressure, hot vapor is delivered to the condenser 24. In the condenser 24, heat is removed from the hot gas and delivered to atmosphere permitting the vapor to condense to liquid and exit the condenser 24 through line 26. The liquid then flows through the expansion valve 28 to reduce its pressure to an intermediate level for introduction to the flash intercooler 16.

The portion of the liquid which does not boil in the flash intercooler 16 is removed through the expansion valve 31 to reduce its pressure to pressure within the evaporator 32 for induction thereinto. The liquid boils in the evaporator 32 and thereby removes heat from the air stream to be cooled.

It should be apparent that the control system consists of four valves, the low and high pressure hot gas bypass valves 42 and 48, respectively, a head regulator 28 and a thermostatic expansion valve 31.

The cycle pressures are primarily set by the low pressure hot gas bypass valve 42 on the low pressure side of the system and the head pressure regulator 28 on the high side.

The high pressure hot gas bypass valve 48 regulates the intermediate pressure of the system in a fashion that permits the low and high pressure compressors 12 and 20 respectively, to operate at an optimum pressure ratio for efficiency.

The thermostatic expansion valve 31 regulates refrigerant flow to the evaporator in accordance with cooling air demand. The valve monitors low pressure stage inlet pressure and temperature and controls refrigerant flow to maintain relatively constant superheat conditions at all loads.

While the preferred embodiment of the invention has been disclosed, it should be appreciated that the invention is susceptible of modification without departing from the scope of the following claims.

We claim:

1. A refrigeration system comprising:

a high speed high frequency induction motor having a double-ended shaft with low and high pressure centrifugal refrigerant compressors directly coupled to opposite ends of said shaft;

a flash intercooler;

a first fluid flow path from an outlet on said low pressure compressor to an inlet of said flash intercooler;

a second fluid flow path from the outlet on said low pressure compressor to the inlet of said low pressure compressor having a valve therein for controlling the flow of superheated vapor from said compressor to said flash intercooler thereby to maintain relatively constant compressor flow over a relatively wide range of conditions;

a fluid flow path from said flash intercooler to said high pressure compressor;

a condenser;

a fluid flow path from said high pressure compressor to said condenser;

a fluid flow path from said condenser communicating with the fluid flow path from said low pressure compressor to said flash intercooler;

an evaporator;

a fluid flow path from said flash intercooler to said evaporator; and a fluid flow path from said evaporator to said low pressure compressor.

2. A refrigeration system in accordance with claim 1 wherein said flash intercooler comprises a cylindrical canister;

a conical screen in said canister disposed centrally thereof, and a cylindrical baffle disposed between said canister and said screen.

* * * * *